US006860950B2

(12) United States Patent
Franz et al.

(10) Patent No.: US 6,860,950 B2
(45) Date of Patent: Mar. 1, 2005

(54) METHOD FOR COOLING A HOT-ROLLED MATERIAL AND CORRESPONDING COOLING-LINE MODELS

(75) Inventors: Klaus Franz, Nürnberg (DE); Klaus Weinzierl, Erlangen (DE)

(73) Assignee: Siemens Aktiengesellschaft, Munich (DE)

( * ) Notice: Subject to any disclaimer, the term of this patent is extended or adjusted under 35 U.S.C. 154(b) by 67 days.

(21) Appl. No.: 10/369,951

(22) Filed: Feb. 20, 2003

(65) Prior Publication Data

US 2004/0006998 A1 Jan. 15, 2004

Related U.S. Application Data

(63) Continuation of application No. PCT/DE02/02077, filed on Jun. 7, 2002.

(30) Foreign Application Priority Data

Jun. 20, 2001 (DE) ..... 10129565

(51) Int. Cl.[7] ..... C21D 9/00; C21D 8/02
(52) U.S. Cl. ..... 148/503; 148/511; 148/661
(58) Field of Search ..... 148/504, 500, 148/661, 508, 511

(56) References Cited

FOREIGN PATENT DOCUMENTS

| | | | |
|---|---|---|---|
| DE | 19740691 A1 | 3/1999 | ..... B21B/37/74 |
| EP | 0453566 A1 | 10/1991 | ..... C21D/8/02 |
| EP | 0997203 A1 | 5/2000 | ..... B21B/37/76 |
| WO | 99/13999 | 3/1999 | ..... B21B/37/76 |

OTHER PUBLICATIONS

International Investigation Report, PCT/DE02/02077, Mailed Oct. 25, 2002.

Auzinger et al., "Neues Prozessoptimierungs–und–steuerungssystem fur eine Laminarkuhlstrecke", Stahl und Eisen, pp. 115–120, 163, Nov. 11, 1996.

Visintin, A., "Mathematical Models of Solid–Solid Phase Transitions in Steel", IMA Journal of Applied Mathematics, pp. 143–157, 1987.

*Primary Examiner*—Deborah Yee
(74) *Attorney, Agent, or Firm*—Baker Botts L.L.P.

(57) ABSTRACT

To determine the temperature profile (Tm(t)) of a hot-rolled material (1) in a cooling line (5), a heat conduction equation which takes the following form $$\frac{\partial e}{\partial t} - div\left[\frac{\lambda(e,p)}{\rho}\cdot gradT(e,p)\right] = 0$$

where e is the enthalpy, λ the thermal conductivity, p the degree of phase transformation, ρ the density and T the temperature of the rolled material at the rolled-material location and t is the time, is solved in a cooling-line model (4).

14 Claims, 4 Drawing Sheets

$$\frac{\partial e}{\partial t} - \frac{\partial}{\partial x}\left[\frac{\lambda(e,p)}{\rho} \cdot \frac{\partial T(e,p)}{\partial x}\right] = 0$$

$$\frac{\partial p}{\partial t} = h(e,p)$$

10

METHOD FOR COOLING A HOT-ROLLED MATERIAL AND CORRESPONDING COOLING-LINE MODELS

CROSS-REFERENCE TO RELATED APPLICATION

This application is a continuation of co-pending International Application No. PCT/DE02/02077 filed Jun. 7, 2002, which designates the United States, and claims priority to German application number DE10129565.0 filed Jun. 20, 2001.

BACKGROUND OF THE INVENTION

The present invention relates to a method for cooling a hot-rolled material having a rolled-material cross section, in particular a metal strip, e.g. a steel strip, in a cooling line, comprising the following steps:

- a starting temperature is recorded for a rolled-material location upstream of the cooling line,
- a temporal quantitative coolant profile is determined on the basis of a cooling-line model and predetermined desired properties of the rolled material,
- a coolant is applied to the rolled-material location in accordance with the temporal quantitative coolant profile which has been determined, and
- an expected temporal temperature profile of the rolled material at the rolled-material location across the rolled-material cross section is determined on the basis of the cooling-line model and the temporal quantitative coolant profile.

The present invention also relates to a corresponding cooling-line model.

A cooling method of this type and the corresponding cooling-line model are known, for example, from "Stahl und Eisen", Volume 116 (1996), No. 11, pages 115 to 120.

The exact modeling of the temporal temperature profile during cooling of a hot-rolled metal strip is of crucial importance for controlling the quantitative coolant profile. Since, furthermore, the cooling is not in thermodynamic equilibrium, phase transitions in the rolled material to be cooled, e.g. a phase transformation in steel, have a crucial effect on the thermal characteristics during cooling. Therefore, the phase transformation has to be incorporated in Fourier's law of heat conduction.

The modeling of the phase transformation in turn requires the temperature as an input parameter. This results in a coupled differential equation system which can be approximately solved numerically, e.g. by a starting value problem solver. In this approach, it is necessary to solve Fourier's heat conduction equation together with the dynamics of the phase transformation.

Two methods are customary in the prior art.

In the first of these, the phase transformation is initially modeled on the basis of an approximate temperature profile. Then, the phase transformation is frozen. The exothermic events in the phase transformation are then taken into account in Fourier's heat conduction equation by means of heat sources. This approach partially neglects the link between the phase transformation and the temperature.

Although another method does couple the phase transformation to the solution to the Fourier's heat conduction equation, in this method too exothermic events in the phase transformation are simulated by heat sources in the Fourier's heat conduction equation.

However, the methods of the prior art only appear to solve the problem. In fact, in both cases the approach is incorrect under the laws of physics. This is demonstrated in particular by the fact that the heat source has to be separately parameterized in the cooling-line model.

SUMMARY OF THE INVENTION

The object of the present invention is to provide a cooling method and the corresponding cooling-line model by means of which the temperature of the rolled material which is to be cooled and also its phases and phase transitions are correctly described.

For the cooling method, the object is achieved by the fact that a heat conduction equation of the following form $$\frac{\partial e}{\partial t} - div\left[\frac{\lambda(e, p)}{\rho} \cdot gradT(e, p)\right] = 0$$

where e is the enthalpy, λ the thermal conductivity, p the degree of phase transformation, ρ the density and T the temperature of the rolled material at the rolled-material location and t is the time, is solved in the coolant-line model in order to determine the temperature profile in the rolled material.

The variables e and p are in this case position- and time-dependent. div and grad are the generally known operators divergence and gradient, which act on the position variables.

Correspondingly, the object for the cooling-line model is achieved by the fact that it, in order to determine the temperature profile in the rolled material, includes a heat conduction equation of the following form $$\frac{\partial e}{\partial t} - div\left[\frac{\lambda(e, p)}{\rho} \cdot gradT(e, p)\right] = 0$$

where e is the enthalpy, λ the thermal conductivity, p the degree of phase transformation, ρ the density and T the temperature of the rolled material at the rolled-material location and t is the time.

The above equation still needs to be supplemented in the usual way with starting and boundary conditions. These supplements are effected in the same way as is generally customary and known in the prior art. Therefore, the supplements are not dealt with in more detail below.

The inventive solution approach is based on the principle of conservation of energy. Therefore, the Fourier's heat conduction equation is formulated with the enthalpy as a state variable and the temperature as a variable which is dependent on the enthalpy. Heat sources are not required, as can be seen. Therefore, they also no longer have to be parameterized.

Since the approach for the heat conduction equation is now correct, the degree of phase transformation and the enthalpy represent state variables which can be numerically calculated in parallel.

The above solution applies irrespective of the profile of the rolled material which is to be cooled. If the rolled material is a metal strip, the result is essentially a heat flux only in the direction of the strip thickness. By contrast, there is only a negligibly minor heat flux in the strip running direction and in the strip width direction. It is therefore possible to reduce the calculation outlay by considering the heat conduction equation in only one-dimensional form instead of three-dimensional form. In this case, therefore, the heat conduction equation can be simplified to $$\frac{\partial e}{\partial t} - \frac{\partial}{\partial x}\left[\frac{\lambda(e, p)}{\rho} \cdot \frac{\partial T(e, p)}{\partial x}\right] = 0.$$

x in this equation denotes the position variable in the strip thickness direction.

The modeling is improved still further if a finishing temperature is recorded for the rolled-material location downstream of the cooling line, since it is then possible, in particular, to adapt the cooling-line model on the basis of a comparison between the recorded finishing temperature and an expected finishing temperature which is determined on the basis of the expected temporal temperature profile. Therefore, the model can be optimized on the basis of the finishing temperature which has actually been recorded.

Within the context of the cooling-line model, it is also necessary to determine the degree of phase transformation. This can take place in various ways. For example, it is possible to determine the degree of phase transformation using Scheil's rule.

By way of example, it is also possible for the degree of phase transformation (p) to be determined in the cooling-line model on the basis of a differential equation which takes the following form $$\frac{\partial p}{\partial t} = h(e, p).$$

The advantage of this approach consists in the possibility of linking it to Fourier's heat conduction equation without having to renounce the possibility of using a starting value problem solver for the linked calculation of the degree of phase transformation p and the temperature T.

h is a function as described, for example, in Equation 2 on page 144 of the article "Mathematical Models of Solid-Solid Phase Transitions in Steel" by A. Visintin, IMA Journal of Applied Mathematics, 39, 1987, pages 143 to 157.

BRIEF DESCRIPTION OF THE FIGURES

Further advantages and details will emerge from the following description of an exemplary embodiment in conjunction with the drawings, in which.

DETAILED DESCRIPTION OF THE PREFERRED EMBODIMENTS OF THE INVENTION

Figure 1:
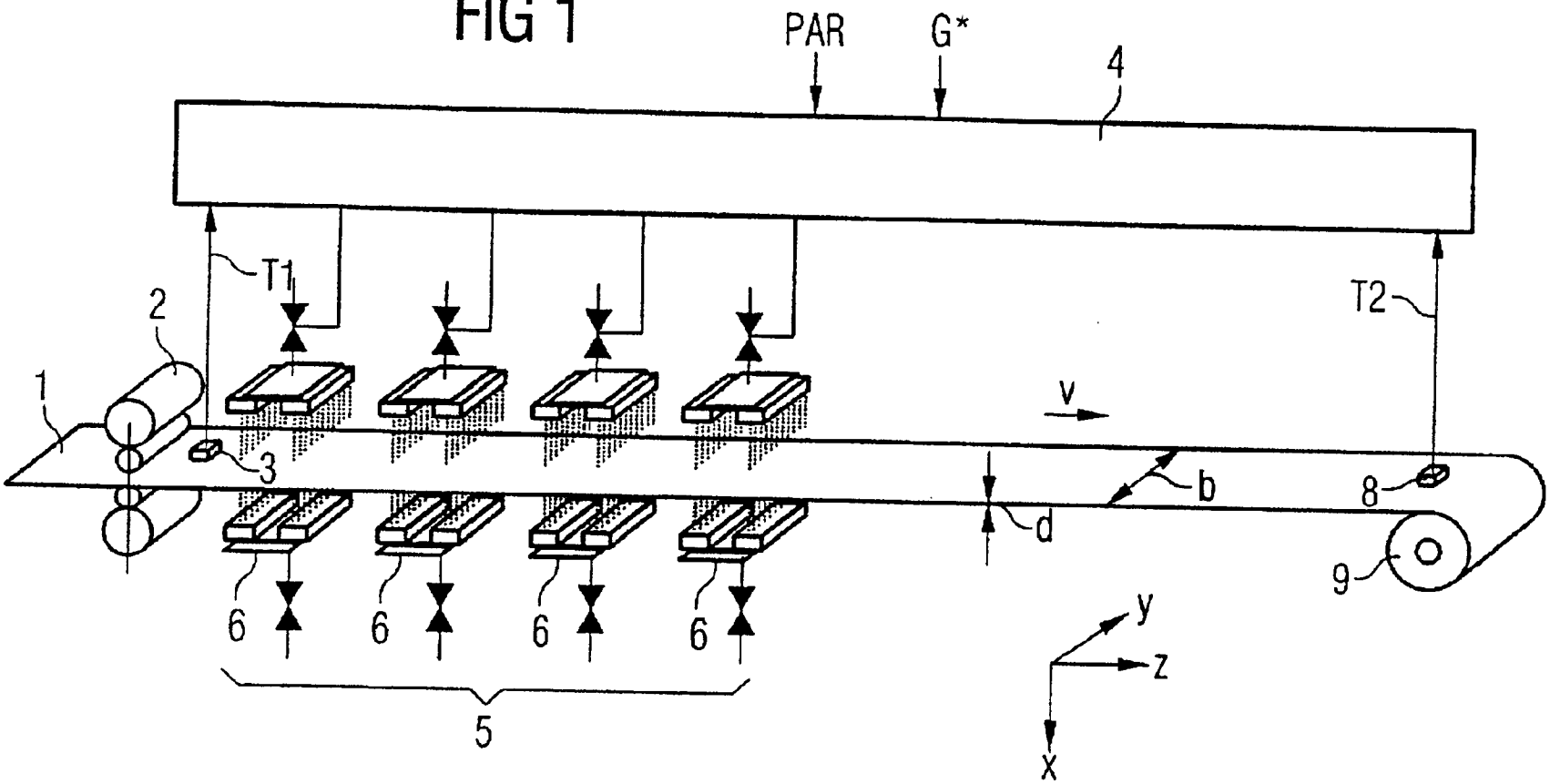
FIG. 1 shows an outline illustration of a cooling line with a metal strip.

As shown in FIG. 1, a hot-rolled material 1 runs out of a rolling stand 2 in a strip running direction z and at a rolling speed v. Downstream of the rolling stand 2 there is a rolling-stand temperature-measuring point 3. In the rolling-stand temperature-measuring point 3, a starting temperature T1 for a rolled-material location is recorded at the surface of the rolled material 1 and is fed to a cooling-line model 4 as an input parameter.

In accordance with FIG. 1, the rolled material 1 is a metal strip, e.g. a steel strip. Therefore, in the width direction y, it has a rolled-material width b and, in a thickness direction x, a rolled-material thickness d. Rolled-material width b and rolled-material thickness d together result in the rolled-material cross section of the rolled material 1.

The starting temperature T1 of the rolled material 1 may vary transversely across the strip width b. The rolled-material temperature-measuring point 3 is therefore preferably designed in such a manner that the starting temperature T1 can be recorded a number of times transversely across the strip width b. By way of example, a plurality of temperature sensors arranged transversely across the strip width b may be provided for this purpose. It is also possible to provide a temperature sensor, upstream of which there are optics by means of which scanning in the strip width direction y is possible.

Downstream of the rolling-stand temperature-measuring point 3 there is a cooling line 5. The cooling line 5 has cooling devices 6, by means of which a coolant 7, typically water 7, can be applied to the rolled material 1 from above, from below or from both sides. The way in which the coolant is applied is matched to the profile which is to be rolled.

A coiler temperature-measuring point 8 is arranged downstream of the cooling line 5. The coiler temperature-measuring point 8 can be used to record a corresponding finishing temperature T2 for the rolled-material location, and this finishing temperature is likewise fed to the cooling-line model 4. The coiler temperature-measuring point 8 is designed in the same way as the rolling-stand temperature-measuring point 3.

Downstream of the coiler temperature-measuring point 8 there is a coiler 9 onto which the metal strip 1 is coiled.

The arrangement of the coiler 9 is typical of the rolling of strips. If profile sections are being rolled, there is usually a different unit instead of the coiler 9, for example a loop laying head in wire rolling mills.

When it reaches the coiler 9, the rolled material 1 should be at a predetermined temperature and should have desired microstructural properties G*. To achieve this, it is necessary for the metal strip 1 to have a corresponding temperature profile between the rolling stand 2 and the coiler 9. This temperature profile is calculated by means of the cooling-line model 4.

Figure 2:
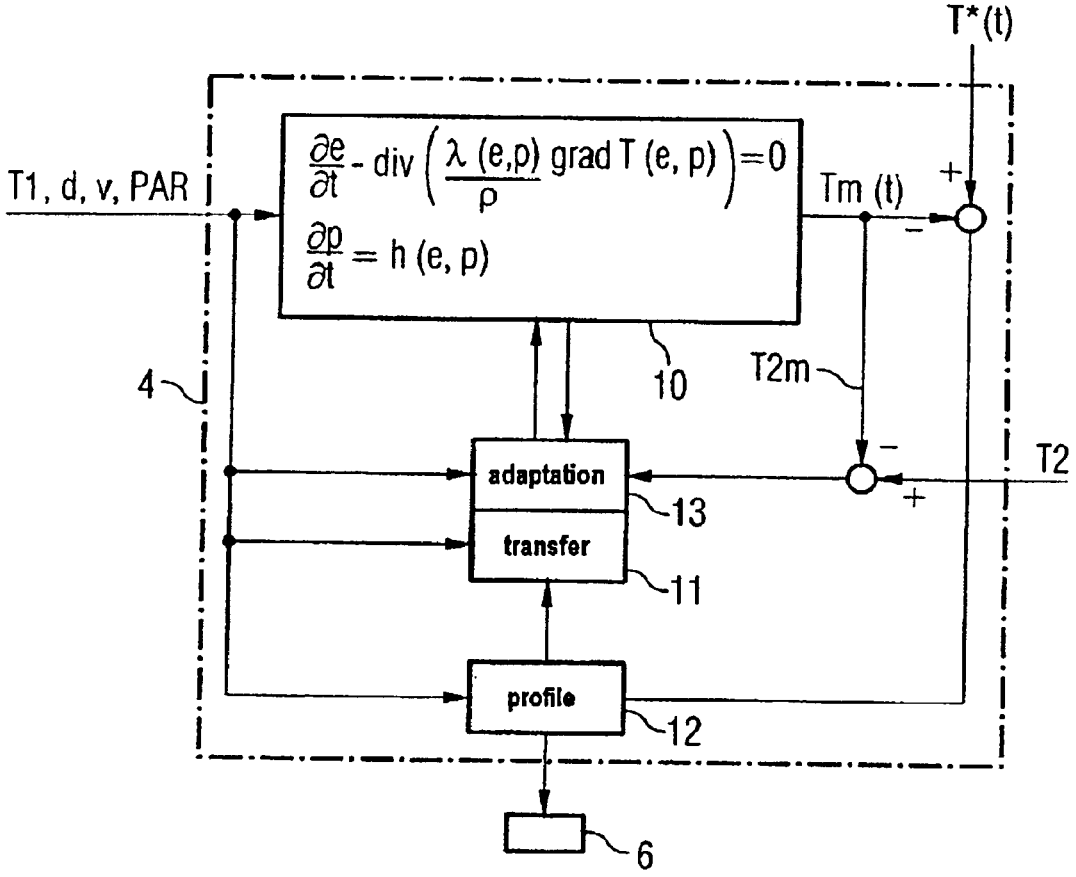
FIG. 2 shows an outline illustration of a cooling-line model.

The cooling-line model 4 is fed with various values as shown in FIG. 1 and 2. First of all, the rolling speed v is fed to the cooling-line model 4. In particular material tracking can be carried out on the basis of this fact.

Then, the strip thickness d, the starting temperature T1 and various parameters PAR are fed to the cooling-line model 4. The parameters PAR comprise in particular actual and desired parameters of the strip 1. An example of an actual parameter is the alloy of the metal strip 1 or its strip width b. An example of a desired parameter is the desired coiler temperature.

As shown in FIG. 2, the cooling-line model 4 comprises a heat conduction model 10, a heat transfer model 11 and a quantitative coolant profile determining means 12. The cooling-line model 4 then determines an expected temporal temperature profile Tm(t). The expected temperature profile Tm(t) is compared with a desired temperature profile T*(t). The result of the comparison is fed to the quantitative coolant profile determining means 12. The latter then uses the difference to determine a new quantitative coolant profile in order to move the expected temperature profile Tm(t) to the desired temperature profile T*(t).

After matching has taken place, the cooling devices 6 of the cooling line 5 are then controlled accordingly by the quantitative coolant profile determining means 12. The coolant 7 is therefore applied to the corresponding rolled-material location in accordance with the temporal quantitative coolant profile which has been determined.

A heat conduction equation is solved in the heat conduction model 10 in order to determine the expected temperature profile Tm(t). The heat conduction equation takes the following form $$\frac{\partial e}{\partial t} - div\left[\frac{\lambda(e,\ p)}{\rho} \cdot gradT(e,\ p)\right] = 0.$$

In the formula, e denotes the enthalpy, λ the thermal conductivity, p the degree of phase transformation, ρ the density and T the temperature of the rolled material 1 at the rolled-material location, and t denotes the time.

Furthermore, the degree of phase transformation p and its temporal profile have to be determined in order to correctly solve the heat conduction equation. This preferably takes place on the basis of a differential equation which takes the following form $$\frac{\partial p}{\partial t} = h(e,\ p).$$

h is a function as described, for example, in Equation 2 on page 144 of the article "Mathematical Models of Solid-Solid Phase Transitions in Steel" by A. Visintin, IMA Journal of Applied Mathematics, 39, 1987, pages 143 to 157.

The above equations have to be solved at the rolled-material location for the entire rolled-material cross section. Furthermore, it may also be necessary to take account of the heat flux in the strip running direction z.

The relationship λ(e,p) can be approximated in the equations for example by means of the following function $$\lambda(e,p)=p\lambda(e,1)+(1-p)\lambda(e,0).$$

Figure 3:
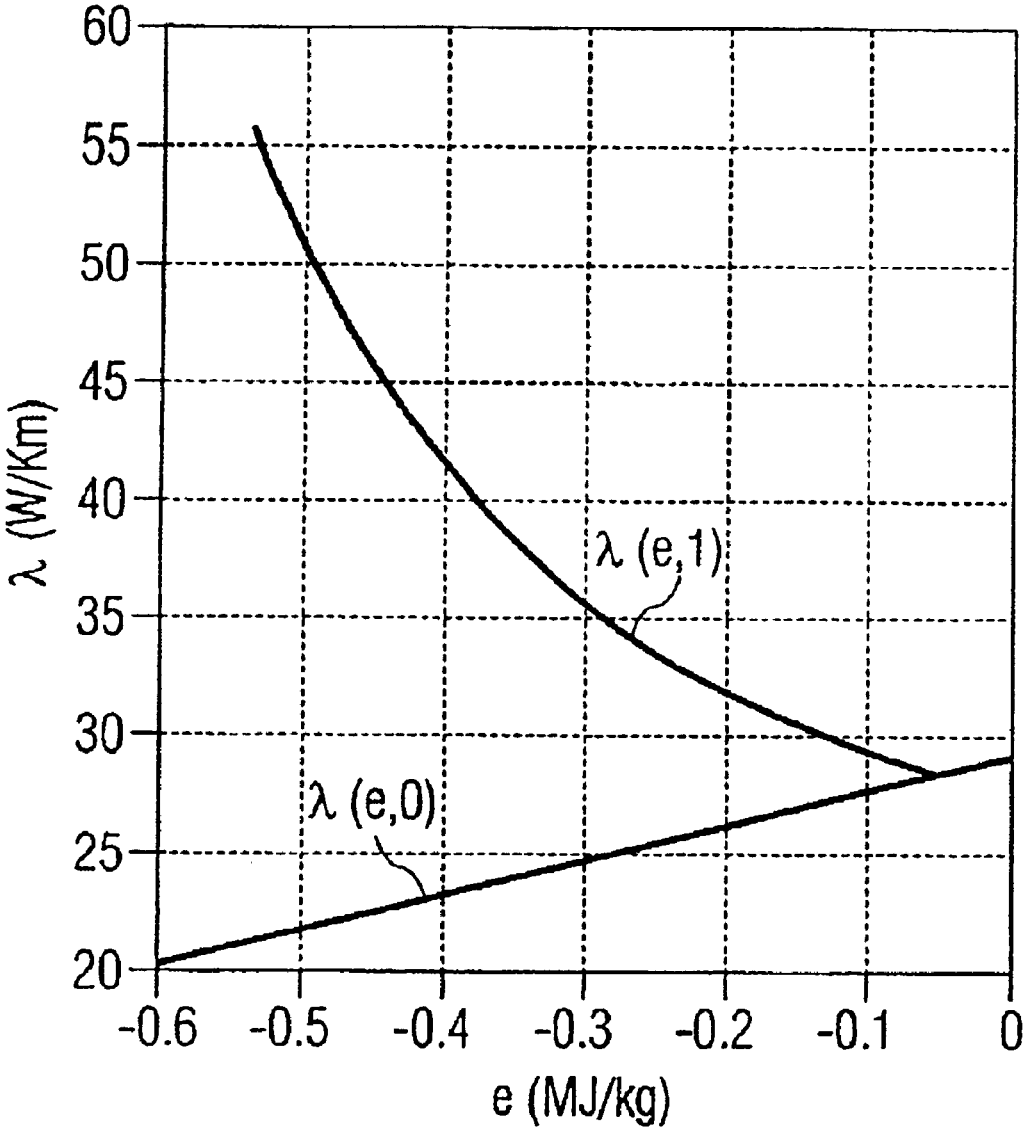
FIG. 3 shows an outline illustration of the thermal conductivity as a function of the enthalpy for two different degrees of phase transformation.

In this case, in one exemplary configuration, λ(e,1) and λ(e,0) are functions as shown in FIG. 3.

The relationship T(e,p) can be approximated, for example, by means of the following function $$T(e,p)=pT(e,1)+(1-p)T(e,0).$$

Figures 4, 5:
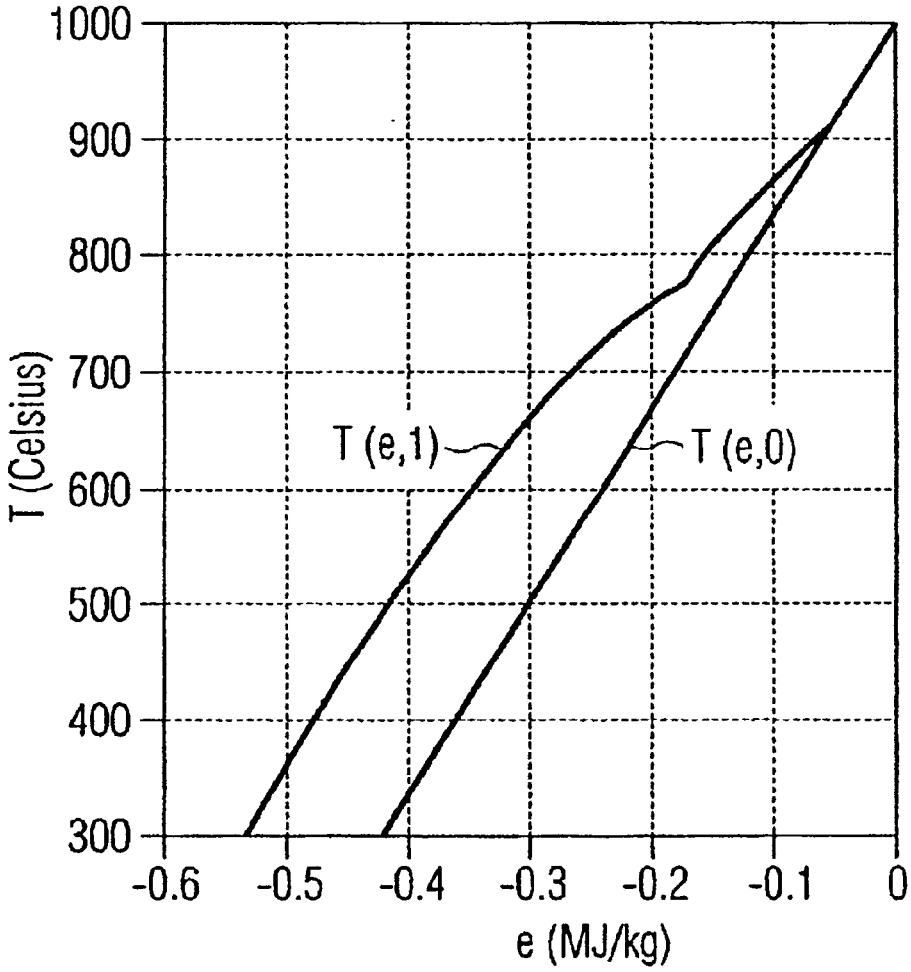
FIG. 4 shows an outline illustration of the temperature as a function of the enthalpy for two different degrees of phase transformation.
FIG. 5 shows an outline illustration of a heat conduction model.

In this case, T(e,1) and T(e,0) are functions as shown by way of example in FIG. 4.

Until the metal strip 1 has reached the coiler temperature-measuring point 8, the only actual temperature value available is the starting temperature T1. However, as soon as the finishing temperature T2 can also be recorded, this temperature can be compared with a finishing temperature T2*m* which was expected on the basis of the prior calculation. The result of the comparison is fed to an adaptation element 13. By way of example, the heat transfer model 13 can be adapted by means of the adaptation element 13.

In the cooling-line model 4 which is illustrated in FIG. 2 and has been explained above, the heat conduction equation $$\frac{\partial e}{\partial t} - div\left[\frac{\lambda(e,\ p)}{\rho} \cdot gradT(e,\ p)\right] = 0$$

is solved in the context of the heat conduction model 10. However, when metal strip is being cooled, heat flux occurs substantially only in the x direction. It is therefore possible and permissible, as shown in FIG. 5, to arrange the heat conduction model 10 in one-dimensional form. It is therefore sufficient to solve a heat conduction equation which takes the following form $$\frac{\partial e}{\partial t} - \frac{\partial}{\partial x}\left[\frac{\lambda(e,\ p)}{\rho} \cdot \frac{\partial T(e,\ p)}{\partial x}\right] = 0.$$

This procedure requires a considerably reduced calculation outlay with only a slightly worse result, since in this case only the heat conduction equation for a one-dimensional bar which extends from the underside of the strip to the top side of the strip at the rolled-material location has to be solved.

What is claimed is:

1. A method for cooling a hot-rolled material having a rolled-material cross section in a cooling line, comprising the following steps:

a starting temperature is recorded for a rolled-material location upstream of the cooling line, a temporal quantitative coolant profile is determined on the basis of a cooling-line model and predetermined desired properties of the rolled material, a coolant is applied to the rolled-material location in accordance with the temporal quantitative coolant profile which has been determined, and an expected temporal temperature profile of the rolled material at the rolled-material location across the rolled-material cross section is determined on the basis of the cooling-line model and the temporal quantitative coolant profile, wherein a heat conduction equation of the following form $$\frac{\partial e}{\partial t} - div\left[\frac{\lambda(e,\ p)}{\rho} \cdot gradT(e,\ p)\right] = 0$$

where e is the enthalpy, λ the thermal conductivity, p the degree of phase transformation, ρ the density and T the temperature of the rolled material at the rolled-material location and t is the time, is solved in the coolant-line model in order to determine the temperature profile in the rolled material.

2. The cooling method as claimed in claim 1, wherein a finishing temperature is recorded for the rolled-material location downstream of the cooling line.

3. The cooling method as claimed in claim 2, wherein the cooling-line model is adapted on the basis of a comparison between the recorded finishing temperature and an expected finishing temperature, which is determined on the basis of the expected temporal temperature profile.

4. A method for cooling a hot-rolled metal strip, in particular a steel strip, having a strip thickness (d), in a cooling line, comprising the following steps:

a starting temperature is recorded for a strip location upstream of the cooling line, a temporal quantitative coolant profile is determined on the basis of a cooling-line model and predetermined desired properties of the metal strip, a coolant is applied to the strip location in accordance with the temporal quantitative coolant profile which has been determined, and an expected temporal temperature profile of the metal strip at the strip location across the strip thickness (d) is determined on the basis of the cooling-line model and the temporal quantitative coolant profile, wherein a heat conduction equation of the following form $$\frac{\partial e}{\partial t} - \frac{\partial}{\partial x}\left[\frac{\lambda(e, p)}{\rho} \cdot \frac{\partial T(e, p)}{\partial x}\right] = 0$$

where e is the enthalpy, x the position in the strip thickness direction, λ the thermal conductivity, p the degree of phase transition, ρ the density and T the temperature of the metal strip at the strip location and t is the time, is solved in the cooling-line model in order to determine the temperature profile in the metal strip.

5. The cooling method as claimed in claim 4, wherein a finishing temperature is recorded for the strip location downstream of the cooling line.

6. The cooling method as claimed in claim 5, wherein the cooling-line model is adapted on the basis of a comparison between the recorded finishing temperature and an expected finishing temperature which is determined on the basis of the expected temporal temperature profile.

7. The cooling method as claimed in claim 1, wherein a degree of phase transition (p) is further determined in the cooling-line model on the basis of a differential equation which takes the following form $$\frac{\partial p}{\partial t} = h(e, p).$$

8. A cooling-line model for a hot-rolled material which is to be cooled in a cooling line and has a rolled-material cross section, said model comprising the following parameters:

a starting temperature upstream of the cooling line is recorded of a rolled-material to be fed to the cooling-line model, a temporal quantitative coolant profile can be determined by means of the cooling-line model on the basis of predetermined desired properties of the rolled material, an expected temporal temperature profile of the rolled material at the rolled-material location across the rolled-material cross section can be determined by means of the cooling-line model and the temporal quantitative coolant profile, wherein the cooling-line model, in order to determine the temperature profile in the rolled material, includes a heat conduction equation of the following form $$\frac{\partial e}{\partial t} - div\left[\frac{\lambda(e, p)}{\rho} \cdot gradT(e, p)\right] = 0$$

where e is the enthalpy, λ the thermal conductivity, p the degree of phase transformation, ρ the density and T the temperature of the rolled material at the rolled-material location and t is the time.

9. The cooling-line model as claimed in claim 8, further comprising a finishing temperature, recorded downstream of the cooling line of the rolled-material location.

10. The cooling method as claimed in claim 9, wherein the cooling-line model can be adapted on the basis of a comparison between the recorded finishing temperature and an expected finishing temperature determined on the basis of the expected temporal temperature profile.

11. A cooling-line model for a hot-rolled steel strip to be cooled in a cooling line, said strip having a thickness (d), said model comprising the following parameters:

a starting temperature (T1), recorded downstream of the cooling line, of a strip location is fed to the cooling-line model, a temporal quantitative coolant profile is determined by means of the cooling-line model on the basis of predetermined desired properties of the steel strip, an expected temporal temperature profile of the strip at the strip location across the strip thickness (d) can be determined by means of the cooling-line model and the temporal quantitative coolant profile, wherein the cooling-line model, in order to determine the temperature profile in the strip includes the following heat conduction equation:

$$\frac{\partial e}{\partial t} - \frac{\partial}{\partial x}\left[\frac{\lambda(e, p)}{\rho} \cdot \frac{\partial T(e, p)}{\partial x}\right] = 0$$

where e is the enthalpy, x the position in the strip thickness direction, λ the thermal conductivity, p the degree of phase transformation, ρ the density and T the temperature of the strip at the strip location and t is the time.

12. The cooling-line model as claimed in claim 11, further comprising a finishing temperature parameter recorded downstream of the cooling line of the strip location.

13. The cooling method as claimed in claim 12, wherein the cooling-line model is adaptable on the basis of a comparison between the recorded finishing temperature and an expected finishing temperature determined on the basis of the expected temporal temperature profile.

14. The cooling-line model as claimed in claim 8, wherein a degree of phase transformation (p) is determined using the following differential equation:

$$\frac{\partial p}{\partial t} = h(e, p).$$

* * * * *